US007775952B1

(12) United States Patent
Curran

(10) Patent No.: US 7,775,952 B1
(45) **Date of Patent: *Aug. 17, 2010**

(54) BALANCE TRAINING APPARATUS, AND OVER AND UNDER COMBINATION

(75) Inventor: Kevin P. Curran, Springfield, MO (US); Robert D. Curran, Jr., legal representative, Springfield, MO (US)

(73) Assignee: Balance 360, LLC, Springfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/590,490

(22) Filed: Nov. 9, 2009

Related U.S. Application Data

(63) Continuation of application No. 11/986,787, filed on Nov. 26, 2007, now abandoned, and a continuation-in-part of application No. 11/251,313, filed on Oct. 14, 2005, now Pat. No. 7,300,392.

(60) Provisional application No. 60/879,924, filed on Jan. 11, 2007, provisional application No. 60/618,896, filed on Oct. 14, 2004.

(51) Int. Cl.
*A63B 22/14* (2006.01)
*A63B 22/16* (2006.01)

(52) U.S. Cl. ..... 482/146; 482/34

(58) Field of Classification Search ..... 482/34, 482/146–147, 79–80, 70–71; 280/841, 600
See application file for complete search history.

(56) References Cited

U.S. PATENT DOCUMENTS 2,615,495 A 10/1952 Hilliker ..... 472/25
2,714,007 A 7/1955 Jordan ..... 482/146
2,803,461 A 8/1957 Coplin ..... 482/146
2,978,243 A 4/1961 Gabrielson ..... 472/14
3,024,021 A 3/1962 Coplin et al. ..... 482/146
3,298,687 A 1/1967 Douglas ..... 482/132
3,306,626 A 2/1967 Kawada ..... 280/205
3,488,049 A * 1/1970 Sasser, Jr. ..... 482/146
3,604,726 A 9/1971 Tracy ..... 280/205
3,716,229 A 2/1973 Van Der Cleyen et al. .... 482/77
3,806,116 A 4/1974 Malmberg et al. ..... 482/147
3,862,768 A 1/1975 England ..... 280/205

(Continued)

OTHER PUBLICATIONS

Tsai, Elysia, U.S. Appl. No. 60/703,197, filed Jul. 28, 2005.

*Primary Examiner*—Lori Baker
(74) *Attorney, Agent, or Firm*—Jonathan A. Bay

(57) ABSTRACT

A balance trainer has a board with a notional nose and tail, a rolling fulcrum for the board to perch on, and at least one hold-down link extending between one end anchored to ground and another end secured to the notional tail of the board. The board as perched on the rolling fulcrum would—in the absence constraint—afford free tipping tilt along at least one axis. However, the hold-down link supplies constraint such that free leash is given to the to the notional tail of the board so long as the hold-down link is slack. But when the nose of the board dives furthest against the hold-down link, the board either deadens in a fixed pitch angle against the tautened hold-down link, or else can be swung laterally a bit, in sort of a monkey-swing fashion in inverse, giving a training experience like riding on a long surf board.

12 Claims, 13 Drawing Sheets

U.S. PATENT DOCUMENTS

| | | | | |
|---|---|---|---|---|
| 3,863,915 | A | 2/1975 | Pifer | 482/51 |
| 3,984,100 | A | 10/1976 | Firster | 482/79 |
| 4,191,371 | A | 3/1980 | Armer, Jr. | 482/146 |
| 4,491,318 | A | 1/1985 | Francke | 482/147 |
| 4,601,469 | A | 7/1986 | Sasser, Jr. | 482/146 |
| 4,653,748 | A | 3/1987 | Seel et al. | 482/79 |
| 4,749,180 | A | 6/1988 | Boomer | 482/51 |
| 4,817,950 | A | 4/1989 | Goo | 482/146 |
| 4,826,159 | A * | 5/1989 | Hersey | 482/146 |
| 4,966,364 | A | 10/1990 | Eggenberger | 482/146 |
| 5,048,823 | A | 9/1991 | Bean | 482/146 |
| 5,062,629 | A | 11/1991 | Vaughan | 482/51 |
| 5,092,586 | A | 3/1992 | Tuthill et al. | 482/23 |
| 5,152,691 | A | 10/1992 | Moscarello | 434/247 |
| 5,509,871 | A | 4/1996 | Giovanni | 482/51 |
| 5,545,115 | A | 8/1996 | Corcoran | 482/146 |
| 5,584,787 | A | 12/1996 | Guidry | 482/146 |
| 5,613,690 | A | 3/1997 | McShane et al. | 273/449 |
| 5,647,830 | A | 7/1997 | Togao | 482/146 |
| D385,318 | S | 10/1997 | Videtto | D21/191 |
| 5,730,690 | A | 3/1998 | Guidry | 482/146 |
| 5,810,703 | A | 9/1998 | Stack | 482/146 |
| 5,851,166 | A | 12/1998 | Bernardson | 482/79 |
| 5,897,474 | A | 4/1999 | Romero | 482/146 |
| 6,017,297 | A * | 1/2000 | Collins | 482/146 |
| 6,019,712 | A | 2/2000 | Duncan | 482/110 |
| 6,042,521 | A * | 3/2000 | De Giorgis | 482/79 |
| 6,168,551 | B1 | 1/2001 | McGuinness | 482/51 |
| 6,419,586 | B1 | 7/2002 | Chiu | 472/25 |
| 6,543,769 | B1 | 4/2003 | Podoloff et al. | 273/148 B |
| 6,554,748 | B2 | 4/2003 | Tollner | 482/51 |
| 6,616,583 | B1 | 9/2003 | Stack | 482/146 |
| 6,705,977 | B1 | 3/2004 | Ziak | 482/146 |
| D507,026 | S | 7/2005 | Chen | D21/671 |
| 6,916,276 | B1 * | 7/2005 | Robinson | 482/51 |
| 7,112,168 | B2 | 9/2006 | Dalebout et al. | 482/146 |
| 7,137,938 | B2 | 11/2006 | Gottlieb | 482/146 |
| 7,156,790 | B2 | 1/2007 | Johnsen | 482/146 |
| 7,357,767 | B2 | 4/2008 | Tsai | 482/146 |
| 7,566,291 | B2 * | 7/2009 | Lickle | 482/51 |
| 7,601,107 | B2 | 10/2009 | Maloy et al. | 482/123 |
| 2004/0014571 | A1 | 1/2004 | Haynes | 482/142 |
| 2006/0082089 | A1 | 4/2006 | Rejtano | 280/87.042 |
| 2006/0211553 | A1 | 9/2006 | Cantor | 482/146 |
| 2007/0155495 | A1 | 7/2007 | Goo | 463/36 |

* cited by examiner

BALANCE TRAINING APPARATUS, AND OVER AND UNDER COMBINATION

CROSS-REFERENCE TO RELATED APPLICATION(S)

This application is a continuation of U.S. patent application Ser. No. 11/986,787, filed Nov. 26, 2007 now abandoned, which claims the benefit of U.S. Provisional Application No. 60/879,924, filed Jan. 11, 2007; and which is also a continuation-in-part of U.S. patent application Ser. No. 11/251,313, filed Oct. 14, 2005, U.S. Pat. No. 7,300,392, which claims the benefit of U.S. Provisional Application No. 60/618,896, filed Oct. 14, 2004. All the forgoing specifications are incorporated herein by this reference.

BACKGROUND AND SUMMARY OF THE INVENTION

The invention relates to balance boards and, more particularly, to balance boards in connection with people involved in balance and fitness training like surfing, wind-surfing, wake boarding or skate boarding.

The prior art is replete with balance boards for balancing on balls—or in more difficult terminology, spherical rolling fulcrums—with underside bearing surfaces formed as domes. Eg., U.S. Pat. No. 4,191,371-Armer, Jr. An issue with these prior art systems is that when a trainee causes the domed bearing-surface to climb up on the ball on the dome's periphery, gravity always wants to pull the board down such that the ball finds the high center.

It is an object of the invention to provide balance training apparatus including a balance board which overcome these and other shortcomings with the prior art.

It is a further object of the invention to provide the bearing surface of the balance board (ie., the surface which bears against the spherical rolling fulcrums) with frames to frame in the area in which the spherical rolling fulcrums can operate.

It is an additional object of the invention to provide a progressive series of such frames to make progressively smaller the framed-in area under the board in which the training ball can operate.

It is another object of the invention to combine two boards in an over and under arrangement, as separated by a spherical rolling fulcrum and tethered in part by flexible straps, to enable the trainee to tip the board on which he or she is standing and thereby more naturally simulate a real experience on a wave.

It is an additional object of the invention to provide an upper deck board which has a more concave shape and is separated from the receiving board by lifts to provide greater toe and heel contact for the user and a hand hold space which helps in simulating a skate board.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
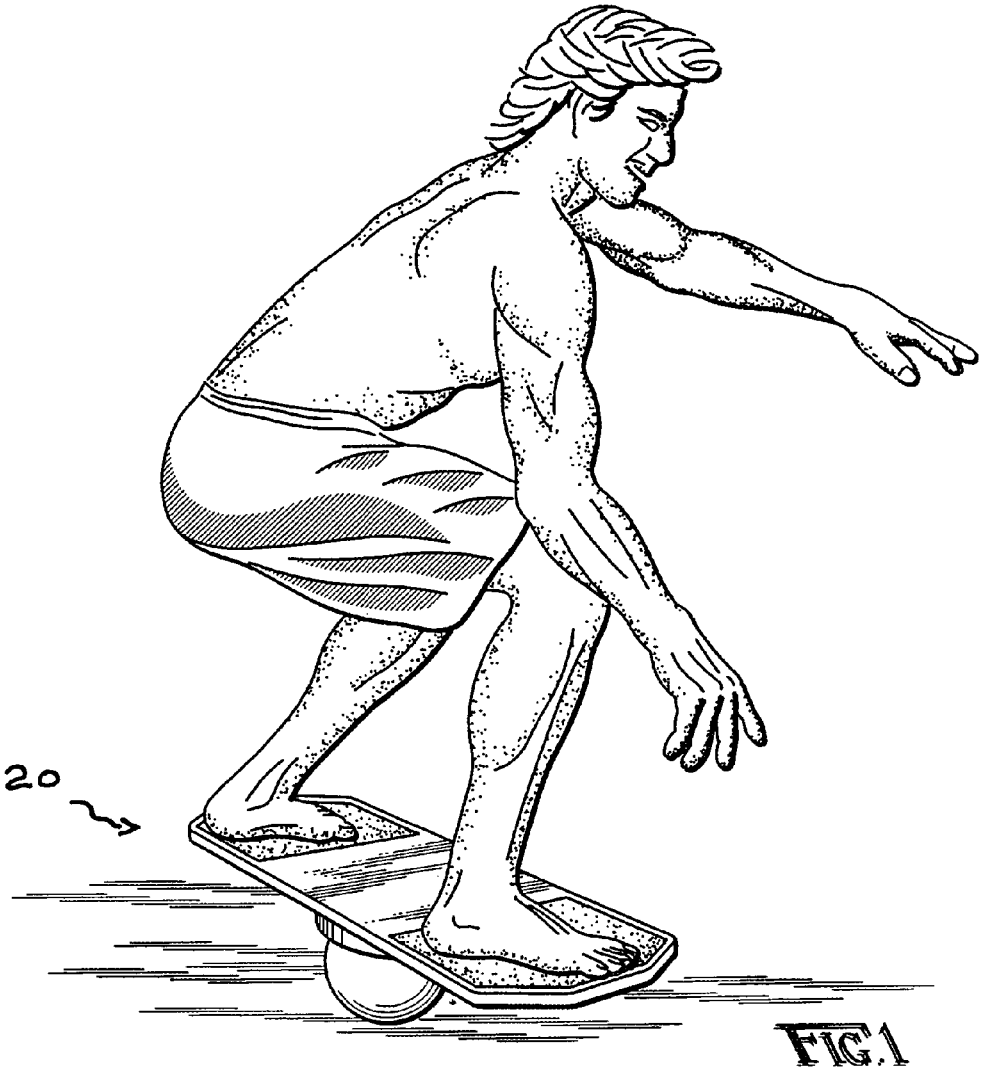
FIG. 1 is a perspective view of a balance training apparatus in accordance with the invention, wherein a trainee is illustrated to show a manner of use.
Figure 2:
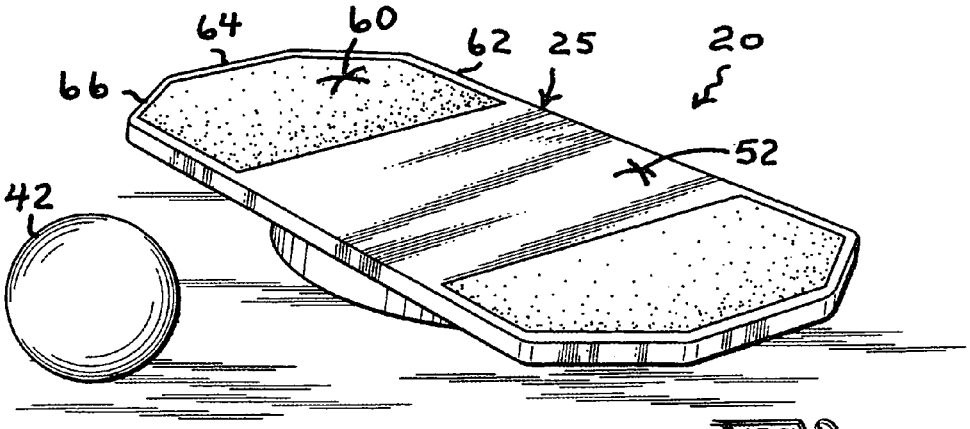
FIG. 2 is an enlarged scale perspective view thereof.

FIG. 1 shows a first embodiment of balance training apparatus 20 in accordance with the invention, with a trainee shown adopting a stance thereon for one non-limiting preferred manner of use thereof.

Figure 3:
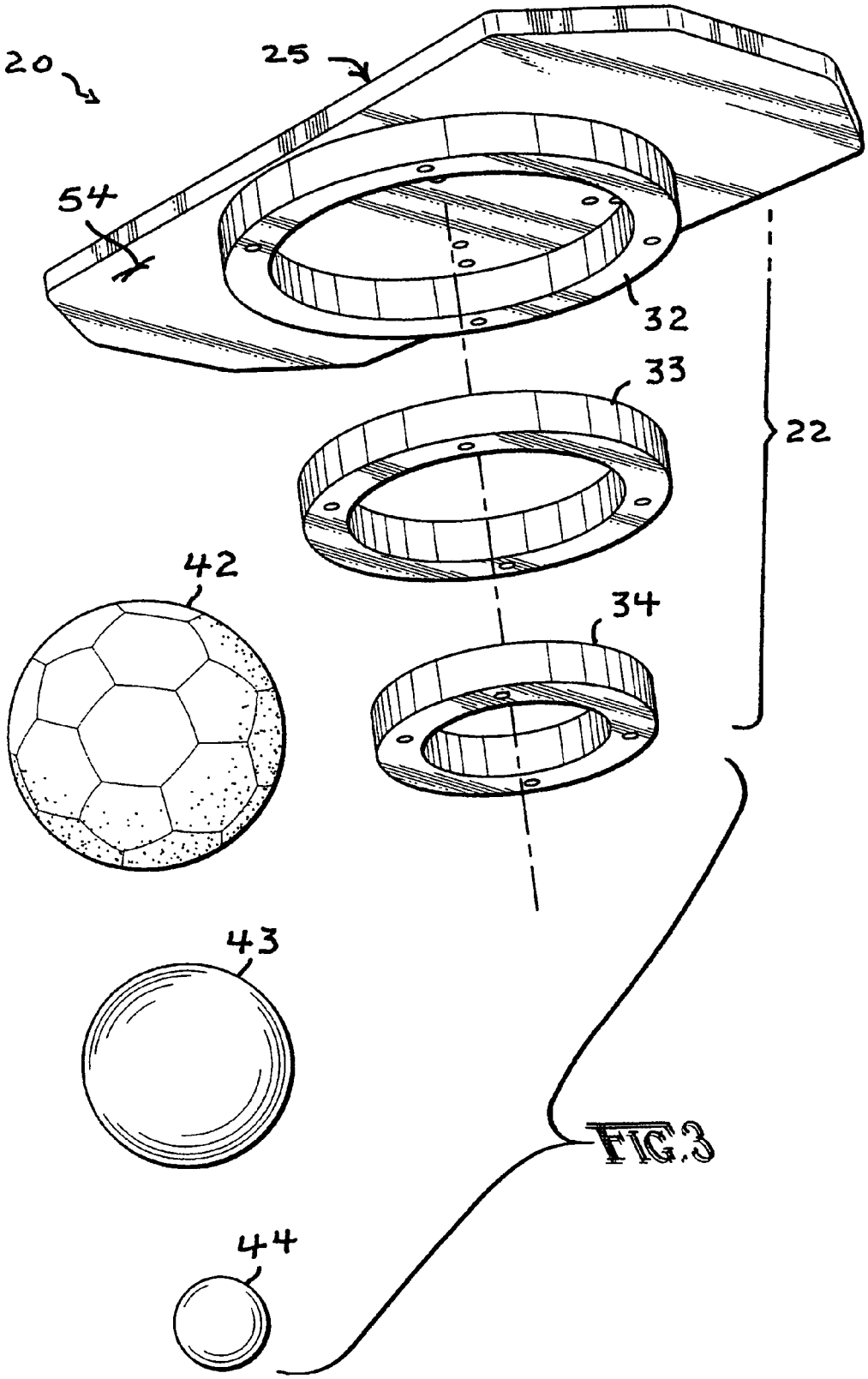
FIG. 3 is an exploded bottom perspective view thereof, except including a progressive series of difficulty-changing training balls therefor (ie., spherical rolling fulcrums)

FIG. 3 shows that such balance training apparatus 20 in accordance with the invention comprises a balance board 22 which includes a platform 25 and progressive series of cylindrical sub-frames 32-34. Said balance training apparatus 20 further comprises a progressive series of training balls 42-44 or, again, spherical rolling fulcrums.

The platform 25 that has an upper footstep surface 52 and a lower bearing surface 54 surrounded by an edge border to be described more particularly below. The progressive series of sub-frames 32-34 have a progressive series of cylindrical inside diameters such that a major sub-frame 32 has the largest, a minor sub-frame 34 has the smallest, and an intermediate sub-frame 33 has of course an intermediate cylindrical inside diameter.

Figure 4:
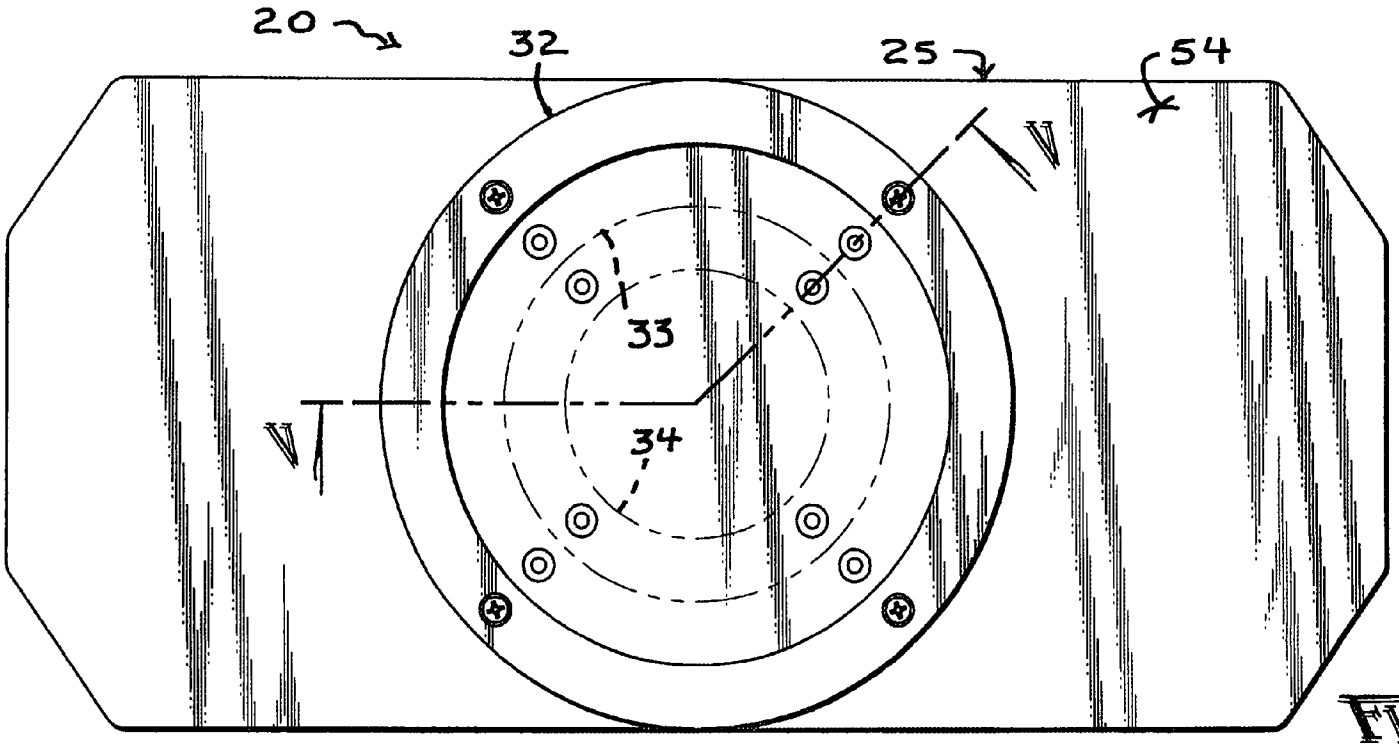
FIG. 4 is an enlarged-scale bottom plan view of the board thereof.

FIG. 4 shows that the progressive series of sub-frames 32-34 preferably nest inside each other as shown with respect to a common center. At least all but the major sub-frame 32 are removable. That is, each sub-frame 32, 33 or 34 encircles its own framed-in area of the bearing surface 54 and thereby defines its own framed-in crown cavity. For example, the major sub-frame 32 encircles a major framed-in area of the bearing surface 54 and thereby defines a major framed-in crown-cavity. Hence the minor sub-frame 34 must be removed to expose all of the area of the bearing surface 54 framed-in by the intermediate sub-frame 33. Correspondingly, both the minor and intermediate sub-frames 34 and 33 must be removed to expose all of the area of the bearing surface 54 framed-in by the major sub-frame 32.

Figure 5:
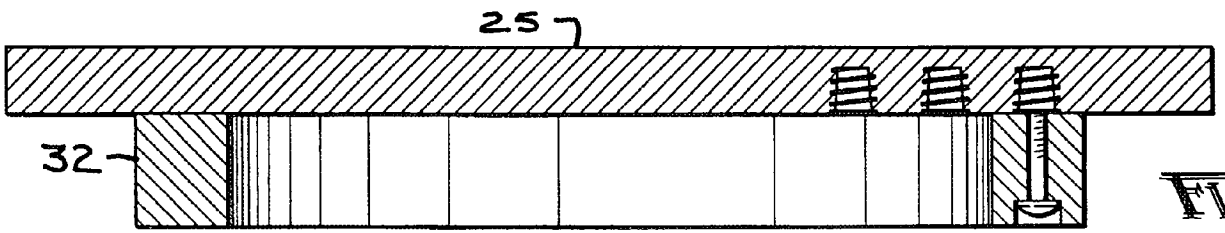
FIG. 5 is a section view taken along offset line V-V in FIG. 4.

One non-limiting example of the invention has the platform 25 constructed of plywood about one-and-one quarter inches (~3 cm) thick. Likewise the sub-frames 32-34 are constructed of plywood, to a thickness of about one-and-three quarters inches (~4½ cm) thick. FIG. 5 shows that all the sub-frames 32-34 removably attached by bolts extending up through the sub-frames 32-34 to tighten in nut inserts commonly used widely in furniture construction.

Figure 6:
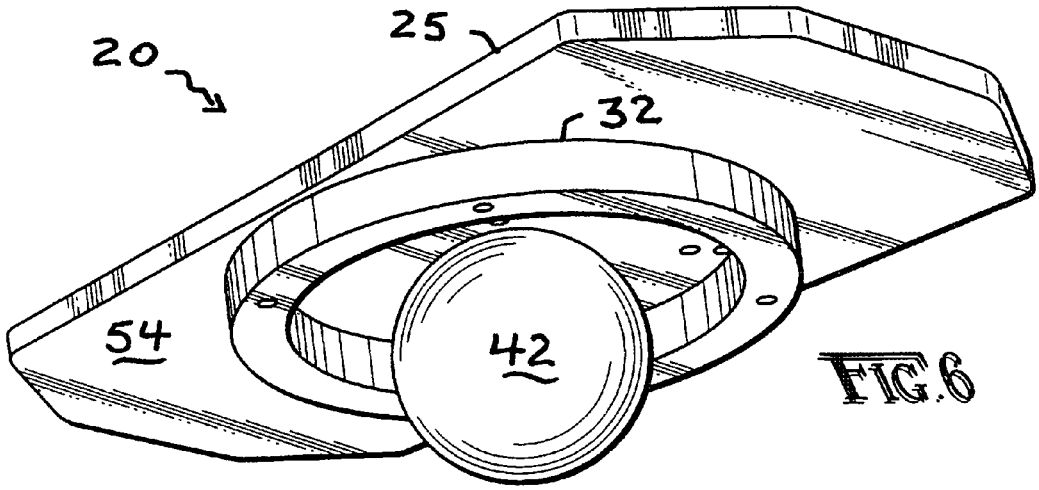
FIG. 6 is a reduced-scale bottom perspective view the FIGS. 4 and 5 version of the board combined with one selected training ball.
Figure 7:
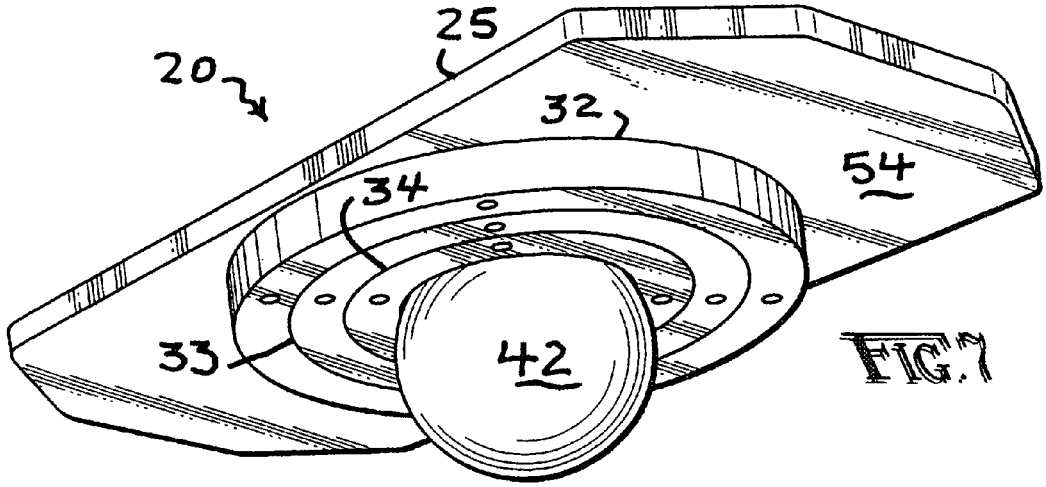
FIG. 7 is a bottom perspective view comparable to FIG. 6 except showing the size of the crown cavity for FIGS. 4 and 5 version of the board reduced in size by two progressive steps.

FIG. 6 shows the balance board 22 affixed with the major sub-frame 32 only and disposed on top of the one the spherical rolling fulcrums (eg., 42). FIG. 7 shows the balance board 22 affixed with the minor sub-frame 34, as well as the intermediate and major sub-frames 33 and 32, which in this case add little except mass to the dynamics of the balance training apparatus 20. However, FIGS. 6 and 7 show very different interaction between the major and minor sub-frames 32 and 34 with this selected training ball 42 (ie., spherical rolling fulcrum).

The following table provides a non-limiting example of relative dimensions for diameters (ie., O.D. stands for outside diameter, I.D. for inside diameter) that are preferred for the progressive series of sub-frames 32-34 and training balls 42-44.

TABLE

| FRAMES | O.D. | I.D. | BALLS | O.D. |
|---|---|---|---|---|
| major | 15½" (~40 cm) | 12½" (~32 cm) | major | 7" (~18 cm) |
| inter-mediate | 12½" (~32 cm) | 9½" (~24 cm) | inter-mediate | 5" (~13 cm) |
| minor | 9½" (~24 cm) | 6½" (~16 cm) | minor | 2½" (~6 cm) |

It can be observed that the largest training ball 42 is larger than the inside diameter defined by the smallest sub-frame 34.

In use, the selected spherical rolling fulcrum 42, 43 or 44 is crowned by the platform 25 within the selected sub-frame 32, 33 or 34 such that the spherical rolling fulcrum 42, 43 or 44 is sandwiched between a ground surface and platform 25. Moreover, the spherical rolling fulcrum 42, 43 or 44 is hemmed-in by the selected sub-frame 32, 33 or 34 in order to corresponding confine its interaction with only the area of the bearing surface 54 framed-in by that selected sub-frame 32, 33 or 34 (or the respective crown-cavity thereof).

It is a generally true rule that the spherical rolling fulcrum 42, 43 or 44 is free to roll sandwiched between the platform 25 and ground surface unless stopped against any portion of the selected sub-frame 32, 33 or 34. However, FIGS. 6 and 7 show very different results from application of the foregoing rule. That is, in FIG. 7, the spherical rolling fulcrum 42 has an outside diameter greater than the minor sub-frame 34's cylindrical inside diameter. Indeed, the minor sub-frame 34 and spherical rolling fulcrum 42 are cooperatively sized such that the minor sub-frame 34 frictionally grips a circle on the spherical rolling fulcrum 42. This frictional gripping stops virtually any possibility of the spherical rolling fulcrum 42 from being able to roll in the minor framed-in area of the bearing surface 54. Accordingly, this limits the platform 25's movement relative to the ground surface to teetering and twirling. Teetering is rocking about a horizontal axis as achieved by pumping legs up and down in alternation of each other (with balance of course). Twirling is spinning about a vertical axis and is more likely achieved by twist in the torso.

Preferably, at least the major and intermediate spherical rolling fulcrums 42 and 43 are inflatable. More preferential still is to utilize novelty soccer or basketballs which are commonly available in many reduced sizes compared to regulation balls used in professional sports. It is an option to provide the balance training apparatus 20 in accordance with the invention with a manual air pump as well (not shown), with an inflation needle. Inflation of the training balls 42 and 43 is achieved with the air pump, whereas deflation is best practiced by disconnecting the needle and leaking out inflated air until the training ball 42 or 43 reaches the desired level of inflation.

Consequently, is an aspect of the invention that the major training ball 42 is selectively inflatable to a selected inflation pressure in order to obtain an optimized frictional grip between the minor sub-frame 34 and major training ball 42 (ie., major spherical rolling fulcrum).

To turn now to FIG. 6, here the major sub-frame 32 is expansively larger than the selected spherical rolling fulcrum 42's outside diameter. Therefore, utilizing the major sub-frame 32 to the exclusion of the progressively smaller sub-frames 33 or 34 frees up the chances of relative rolling between the spherical rolling fulcrum 42 and major framed-in area of the bearing surface 54, unless and until stopped by abutment against the major sub-frame 32. In consequence, this arrangement of things allows the platform 25's possible movement relative the to the ground to include translation as well as teetering and twirling. Translation is linear displacement along the ground (eg., from one spot to another, but not necessarily in a straight line). It may be readily reckoned that there is only a limited extent of linear displacement possible before the training ball 42 limits out against the major sub-frame 32. Nevertheless, the training dynamic between the FIG. 7 arrangement of things and the FIG. 6 one is readily apparent.

The foregoing is highly desirable because this variability in the balance training apparatus 20 in accordance with the invention provides trainees with an indeterminate number of levels of training difficulty.

To turn to matters of the platform 25's planform, and its edge border, the drawings show that the platform 25 has spaced cantilevered shoulders 60 projecting oppositely beyond over not only the minor sub-frame 34 but also the major sub-frame 32. The continuations of the upper footstep surface 52 over to the shoulders 60 are fashioned with grip areas which are intended to encourage trainees to adopt a preferred stance on the platform 25. Their feet preferably would be planted on the grip areas, with legs straddling the center of the sub-frames 32-34 (eg., the center of geometry of the platform 25 too). FIG. 1 provides illustration of one such preferred stance and/or manner of training.

Generally each shoulder 60 extends in a plane generally between spaced parallel sides 62 and a transverse end 64. However, the each shoulder 60 further comprises a pair of spaced diagonal edges 66, and these originate in the parallel sides 62 of the respective shoulder 60 and terminate in the transverse end 64. That way, these diagonal edges 66 eliminate sharp corners between the sides 62 and transverse end 64. Accordingly, trainees more safely ground out the platform 25 on the diagonal edges 66 on the ground surface than if there were sharp corners. Grounding out is considered a wipe out because if such were done in reality on a wake board, surf board, snow board or whatever, surely then the rider would have wiped out (fallen, wrecked). Conversely, stepping off the grip areas and tromping on the flanked center in order to keep one's balance is, while perhaps bad form, not always going to correspond with wiping out. In reality, perhaps such would have corresponded to some chance of recovery.

Figure 8:
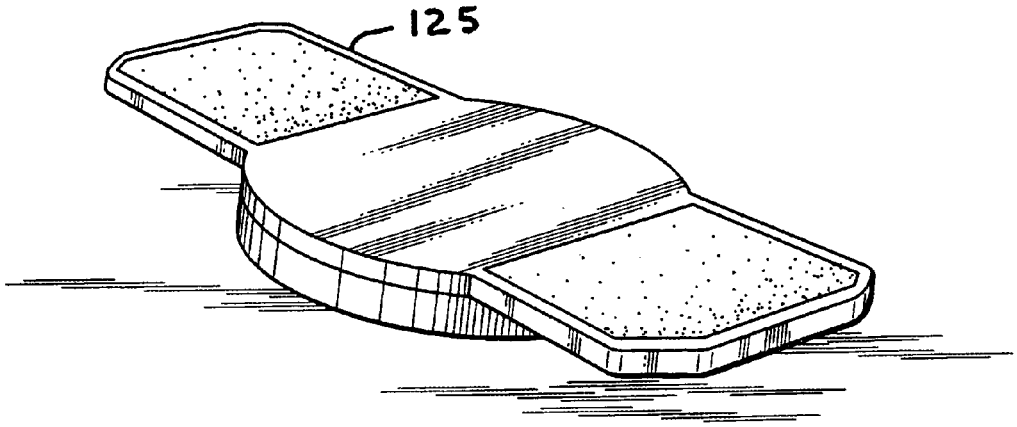
FIG. 8 is a perspective view comparable to FIG. 2 except of an alternate embodiment of a board in accordance with the invention.
Figure 9:
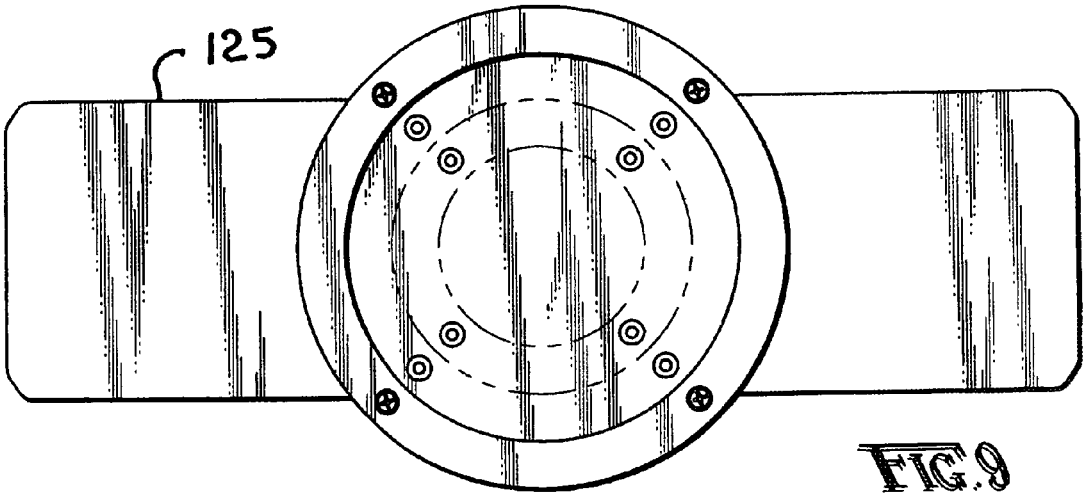
FIG. 9 is an enlarged-scale bottom plan view of FIG. 8's alternate embodiment of the board.

FIGS. 8 and 9 show an alternate embodiment of the platform 125 in accordance with the invention, one with narrower shoulders 60 and more simulative of a surfing experience on a surf board or the like.

Other matters in view of this description of the invention include a remark on what has been described here for convenience in this written description as the ground surface. The ground surface can be any base support surface (planar or not, flat or not), including without limitation outdoor pavement, indoor tiled or carpeted or hard/soft wood floors, beach-side boardwalks, or perhaps even compacted beach sand. However, the ground surface can greatly affect the training dynamics of the balance training apparatus 20 in accordance with the invention. Needless to say, smooth pavement will provide a harder experience than shag carpet, which is where perhaps novices should start.

Whereas preferably the major and intermediate training balls 42 and 43 are inflatable, it is correspondingly preferred if the minor training ball 44 has a solid construction of a suitable polymeric or resinous material.

Wherein preferably the framed-in areas of the bearing surface 54 are flat, because the training experience is totally different, the invention does not exclude a domed bearing surface (this is not illustrated). Since it is preferred to make the bearing surface 54 flat, it is a significant aspect of the invention that trainees can train first with a minor sub-frame 34 and a frictionally-captured major-size training ball 42 before progressively advancing to more difficult combinations. In the more difficult combinations of, say for example, the major sub-frame 32 and the major training ball 42 inflated hard, when a wipe out is about to occur at least the training ball 42 (or 43 and/or 44 for that matter) stops against the major sub-frame 32 to more safely terminate the failed training experience than if the sub-frame 32 (or 33 and/or 34 for that matter) were not there at all.

Figure 10:
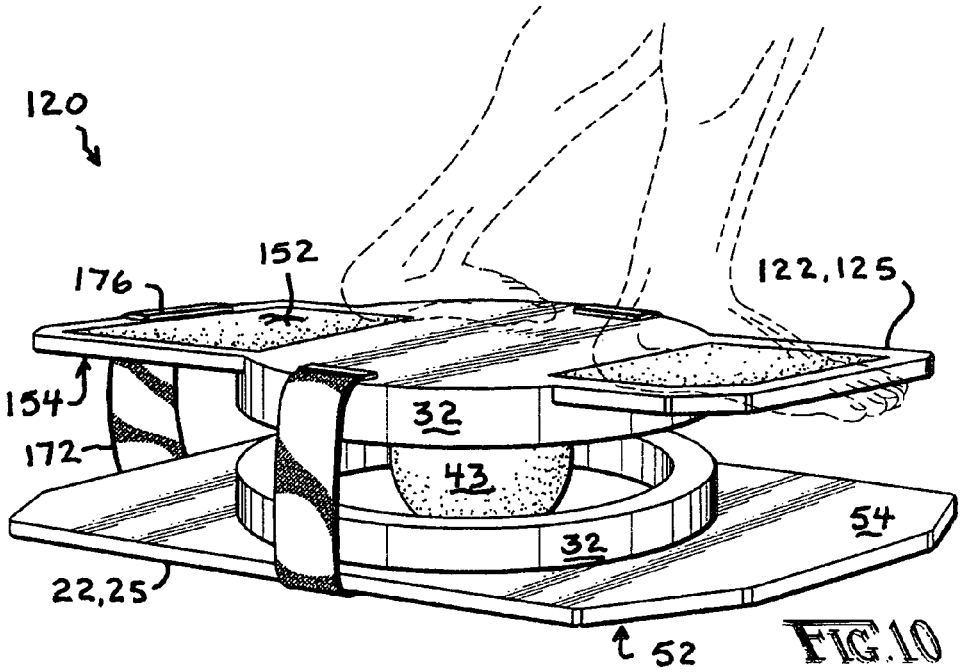
FIG. 10 is perspective view of an alternate embodiment of balance training apparatus in accordance with the invention, wherein two boards are combined in an over and under arrangement, as separated by a training ball and tethered in part by flexible straps, to enable the trainee to tip the board on which he or she is standing and thereby more naturally simulate a real experience on a wave.
Figure 11:
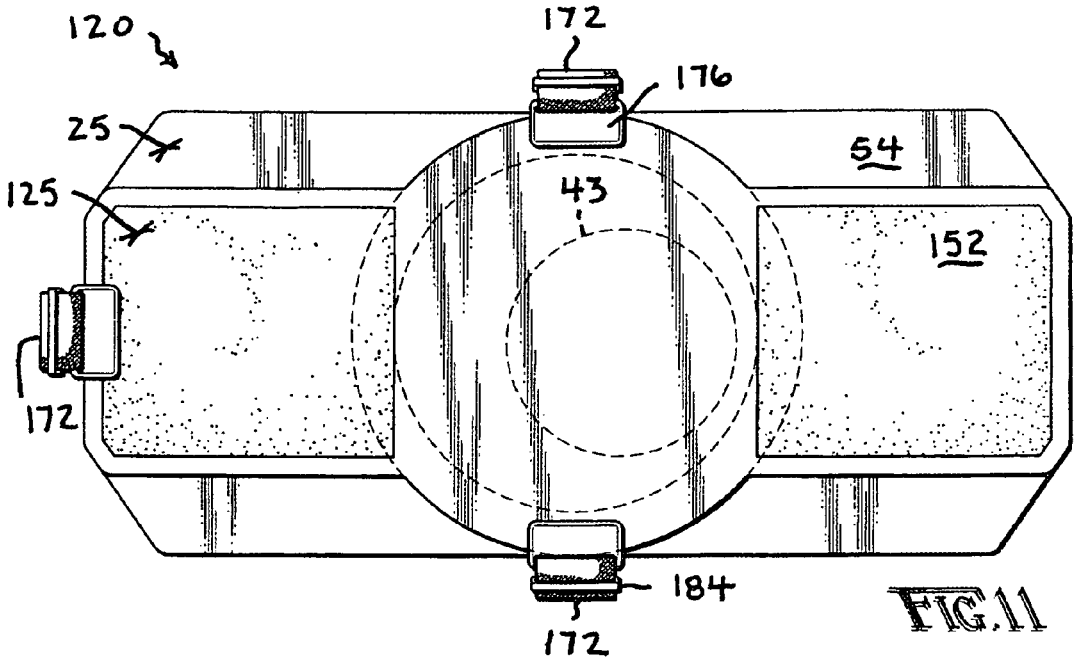
FIG. 11 is a top plan view thereof.
Figure 12:
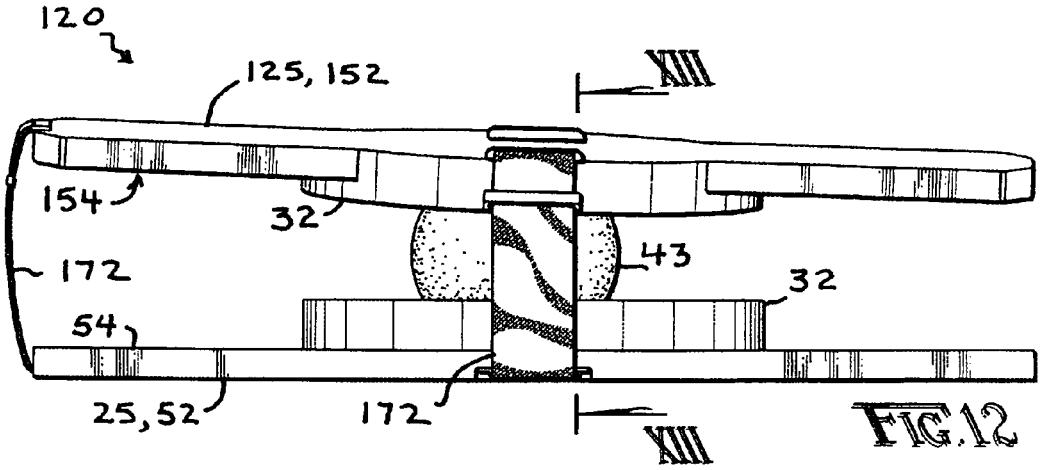
FIG. 12 is a side elevational view thereof.

FIGS. 10 through 12 show an alternate embodiment of balance training apparatus 120 in accordance with the invention. In FIGS. 10 through 12, a board 22 having a platform (or deck) 25 in accordance with FIGS. 1 through 7 is not upright but inverted, with the footstep surface 52 facing down and the bearing surface 54 facing up. A second board 122 having a platform (or deck) 125 in accordance with FIGS. 8 & 9 is situated upright, with the bearing surface 154 thereof facing down of course and footstep surface 152 facing up. Hence the two platforms or decks 25 and 125 are combined in an over and under arrangement 120.

The under deck 25 rests footstep surface 52 down on the base support surface, stationary. The over deck 125 is propped up in spaced balanced on the spherical rolling fulcrum (eg., training ball) 43, and is tethered as shown by way of non-limiting example in the drawings by two straps 172 along the left and right rail edges and a third strap 172 on the tail. Hence the nose or tip edge is cantilevered in space as shown.

Briefly, this over and under arrangement 120 enables the trainee to tip the platform 125 on which he or she is standing and thereby more naturally simulate a real experience on a wave. Perhaps the simulated experience is not so much like the steep downward angle of a surf board sliding nose first down the trough of a wave but instead the less steep downward angle of a surfer angling along the mid-face of a wave, staying just ahead of the whitewater. Alternatively, the training experience might be like that of a surfer riding on a long surf board, on which it is possible to have a stance at the nose of the board, even so much so as to be able to dangle toes over the nose. By way of background, long surf boards had their heyday in the 1960's (but whose popularity is again on the upswing after an extended downswing), and typically measure about nine feet (~2¾ m) long or longer. In contrast, the more modern short surf boards measure in the range of between about six and eight feet (~1⅞ and ~2½ m) long.

Again, the under deck 25's frame 32 faces up and forms a shallow base cavity for containing the training ball 43. In contrast, the over deck 125's counterpart frame 32 faces down and forms a low crown cavity for containing the training ball 43. One selected training ball 43 is sandwiched (trapped) between these two frames 32 and 32. This configuration allows a truly adventurous trainee to balance himself on the cantilevered nose end of the over deck 125. Presumably, this training experience simulates something like surfing on a long board, as when a surfer tiptoes to the very nose end and "hangs ten."

Figure 13:
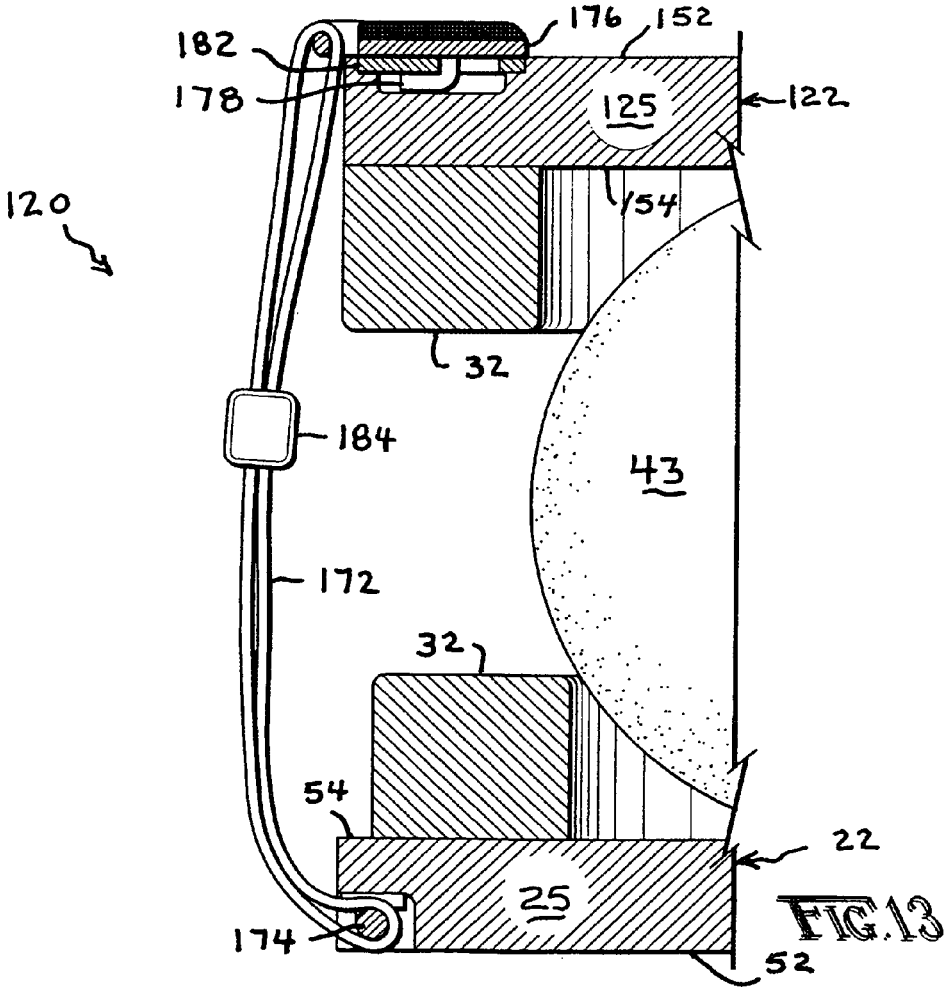
FIG. 13 is an enlarged-scale partial sectional view, with portions broken away, and as taken along line XIII-XIII in FIG. 12.
Figure 14:
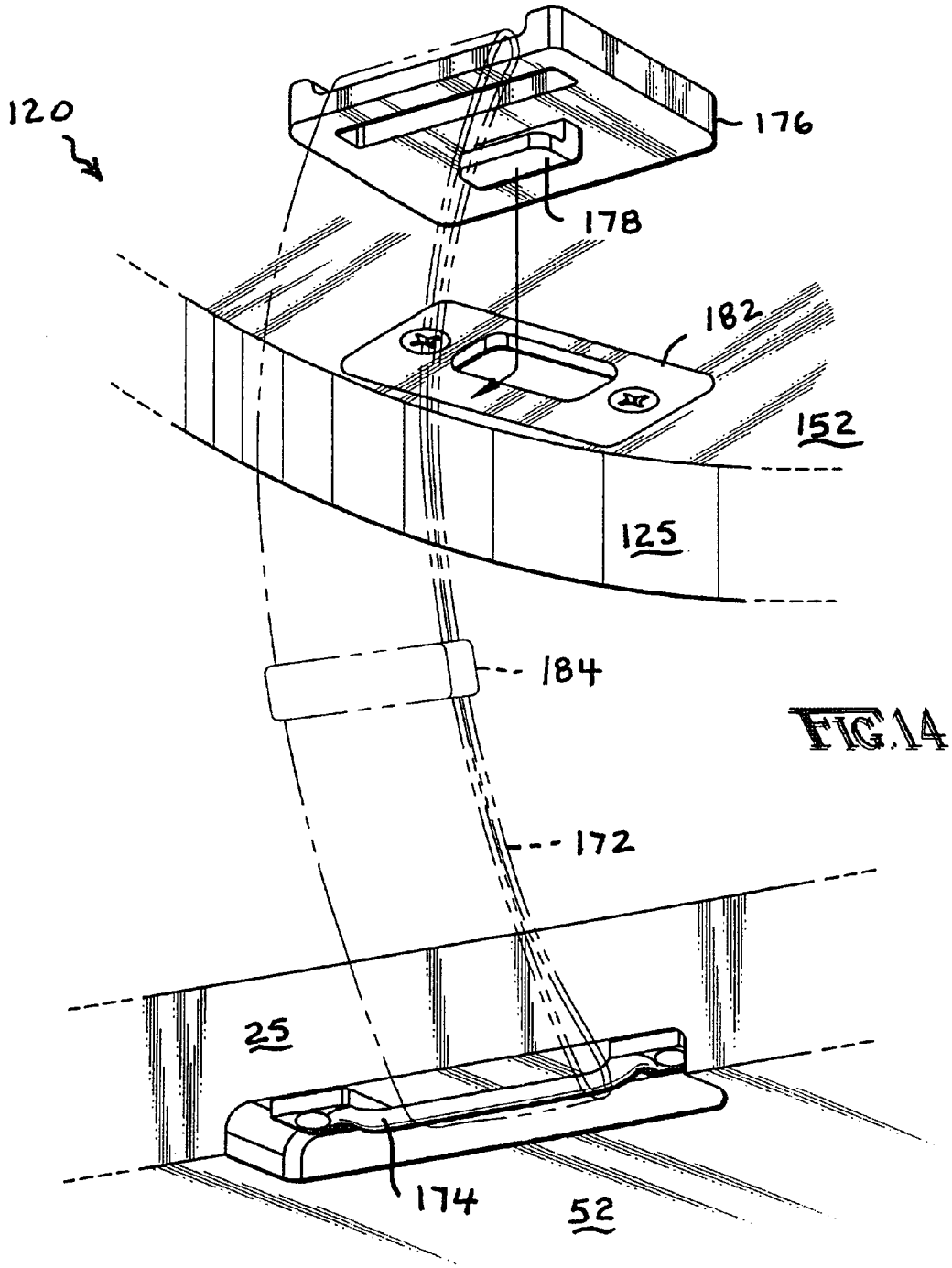
FIG. 14 is a fragmentary detail view taken from the left of FIG. 13, wherein the upper board tips up to the right in the view and the lower board tips down to the right in the view.

FIGS. 10 through 14 show the arrangement of the straps 172 between the over and under decks 125 and 25. The over and under deck 125 and 25 are connected by two side straps 172 and a tail strap 172. There is no strap on the nose end of the decks 125 and 25. The straps 172 are preferably connected to the decks 125 and 25 by a quick connect/disconnect arrangement. The drawings show the straps 125 connected to the under deck 25 by metal footman loops 174 nested inside a corresponding recess therefor in the under deck 25. Alternatively, the straps 172 connect at their opposite extremes by threading through a corresponding slot in a buckle 176 which has a flat hook 178. The over deck 125 has a corresponding set of three apertured strike plates 182 in which the three flat hooks 178 of the three buckles 176 latch into as shown by FIGS. 13 and 14. The purpose of the straps 172 and their placement is that, when the trainee is standing on the balance board 120 and leans the over deck 125 downward where his or her toes are near the nose end of the over deck 125, the straps 172 will provide some positional stability to the over deck 125 to stimulate the experience of a surf board on a wave. However, the trainee must still possess a talented amount of balance to prevent from the over deck 125 from twirling out under him or her clockwise or counterclockwise. The foregoing arrangement 120 of things allows the trainee to hold a position that is most used when surfing to strengthen those particular muscles used.

FIG. 12 shows that when the nose of the over deck 125 is pushed down on the nose end (which is absent a strap), the tail end will lift up, and the tail strap 172 (if properly adjusted) will tighten and keep the over deck 125 from tipping down on its nose.

FIG. 13 shows that the straps 172 are preferably adjustable in length by way of either strap adjusters or slides 184. The straps 172 can therefore be lengthened or shortened, according to the skill of the trainee. The looser the straps 172, the more the over deck 125 will be free to flop about which makes training more difficult. The tighter the straps 172, the less the over deck 125 will can flop about, making training a bit easier. The trainee may start out with the straps 172 tighter and work his or her way to the straps 172 being looser, the more skilled he or she becomes.

FIG. 14 better shows the buckle 176 that has the flat hook 178 which secures to the strike plate 182 in the over deck 125. FIG. 14 also shows better one of the metal footman loops 174 nested inside a recess therefor in the under deck 25. The strike plate 182 is secured to the over deck 125 by screw fasteners or the like. The over deck 125 has a sunken-in well recessed into it underneath the aperture in the strike plate 182 to allow insertion of the flat hook 178 therein. To connect the flat hook 178, a user inserts the flat hook 178 into the aperture of the strike plate 182. This will firmly hold the buckle 176 and its attached strap 172 to the over deck 125, and allows the strap 172 to be readily disconnected as well. The strap 172 stays with the buckle 176 and when wanted, the trainee simply attaches the flat hook 178 to the strike plate 182 on the over deck 125. This provides for quick changeover from and over and under arrangement 120 as shown by FIGS. 10 through 14 to either of the alternative arrangements 20 as shown by either FIGS. 1 through 7 or FIGS. 8 and 9.

Figure 15:
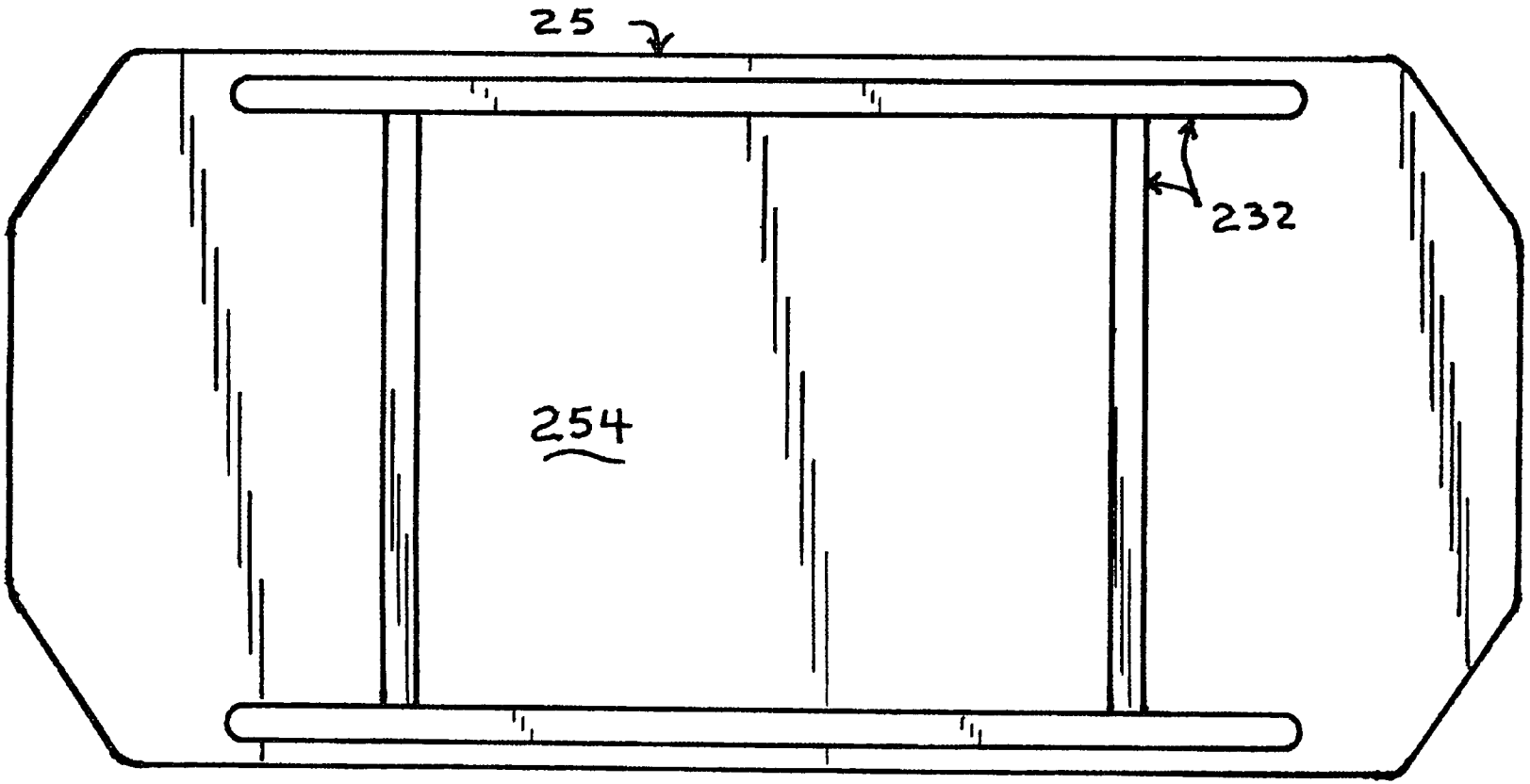
FIG. 15 is a bottom plan view comparable to FIG. 4 except showing an alternate arrangement of the sub-frame therefor.

FIG. 15 is comparable to FIG. 4 except showing the platform 25 provided with an alternate arrangement of a sub-frame, indicated here by reference numeral 232.

As mentioned previously, one non-limiting example of construction of the invention has the platform 25 constructed of plywood about one-and-one quarter inches (~3 cm) thick. Conversely to what was mentioned previously, it would be preferred without limitation to have the option of constructing the sub-frame 232 not out of plywood but out of any beam-style dimensional construction material, such as and without limitation wooden two-by-two's (ie., square stock material measuring about one-and-three quarters inches or ~4½ cm on a side).

That way, the sub-frame 232 is more readily fabricated with less waste left-over material in a series of straight courses. As FIG. 15 shows, the sub-frame 232 is constructed out of a spaced pair of longitudinally-extending side beams spaced apart by a spaced pair of laterally-extending cross beams to enclose a rectangular bearing surface 254.

Despite that the previous views depict sub-frames enclosing a circular bearing surface area 54 or 154, this is a design preference only and production considerations may weigh in favor of non-circular geometries so that the sub-frame (eg., 254) may be constructed out of beam-style dimensional construction material. Preferably the beams of the sub-frame are attached by fasteners or bolts that tighten into nut inserts as commonly used widely in furniture construction, which are sunk into the platform 25.

Figure 16:
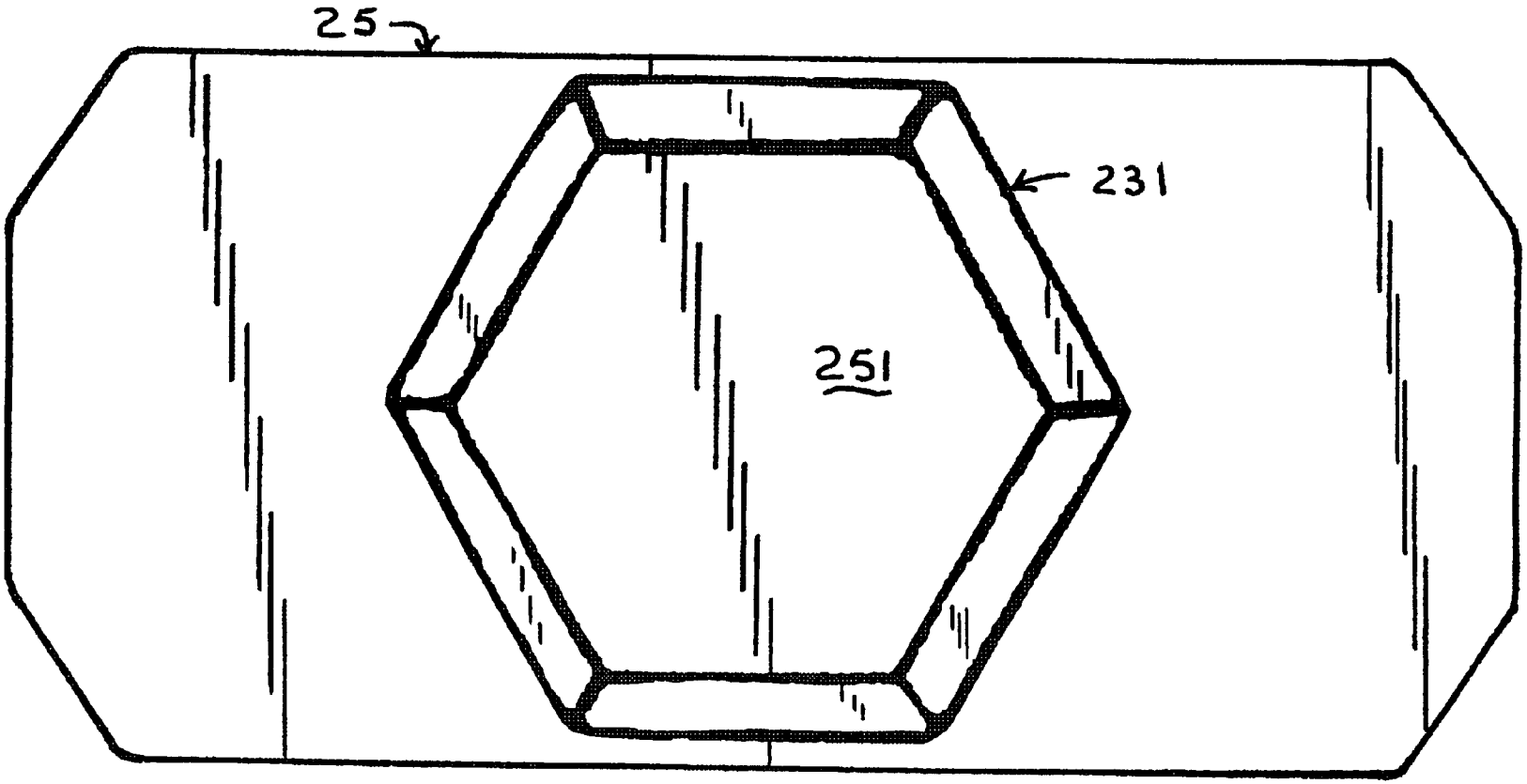
FIG. 16 is a bottom plan view comparable to FIGS. 4 and 15 except showing another arrangement of the sub-frame.

Persons ordinarily skilled in art would readily recognize that other geometries can be readily adopted and still be constructed of beam-style dimensional construction material, including as shown by way of a non-limiting example in FIG. 16.

To turn to FIG. 16, it shows the platform 25 provided with another arrangement of a sub-frame, indicated here by reference numeral 231. FIG. 16 shows the sub-frame 231 is constructed out of six similarly-shaped beams to enclose a six-sided or hexagonal bearing surface 251.

Figure 17:
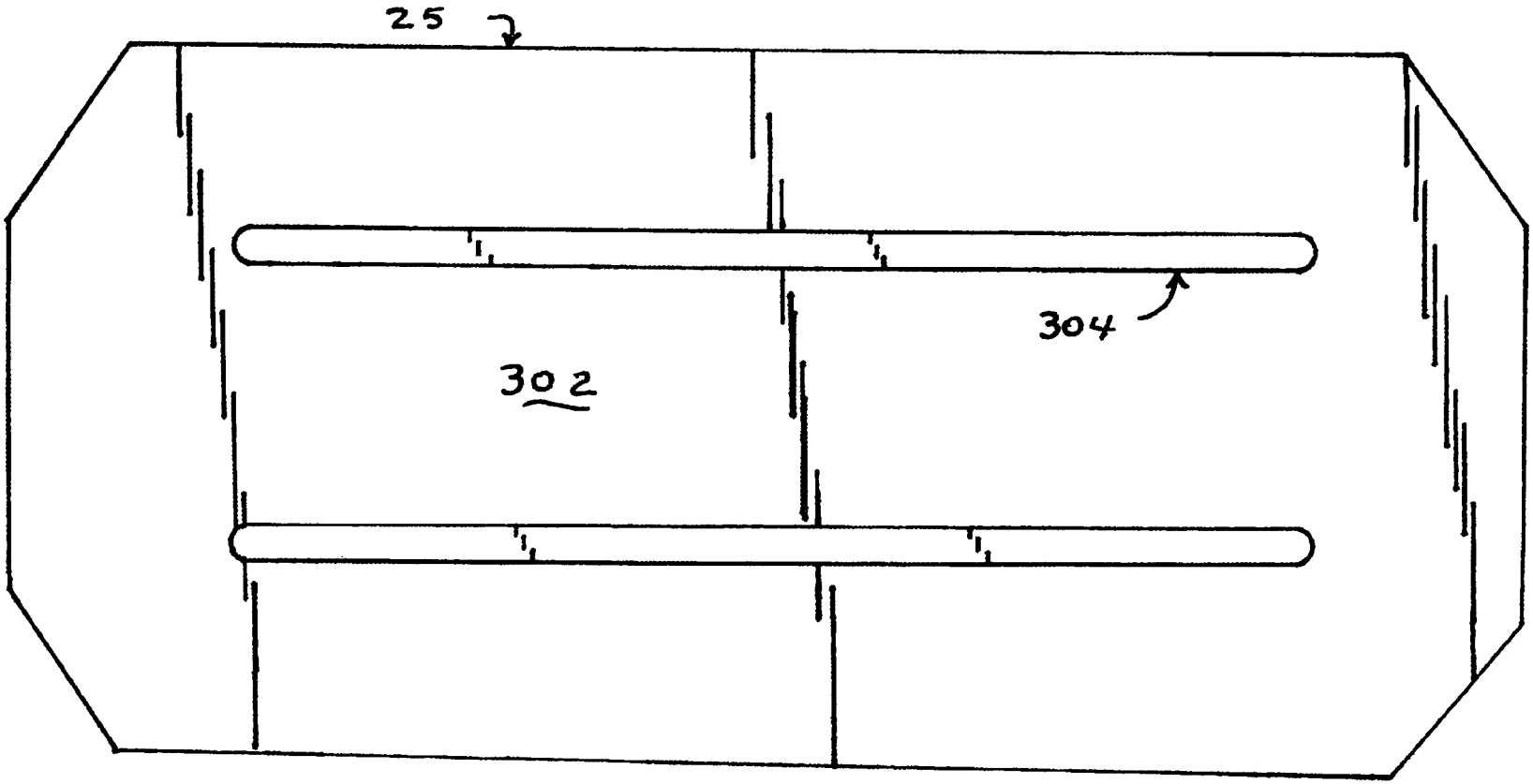
FIG. 17 is a bottom plan view comparable to FIGS. 4, 15 and 16 except showing an additional arrangement of the sub-frame.

FIG. 17 shows the platform 25 provided with an additional arrangement of a sub-frame, indicated here by reference numeral 304. FIG. 17 shows the sub-frame 304 is constructed out of two elongated beams parallel to each other bearing surface 302.

Figure 18:
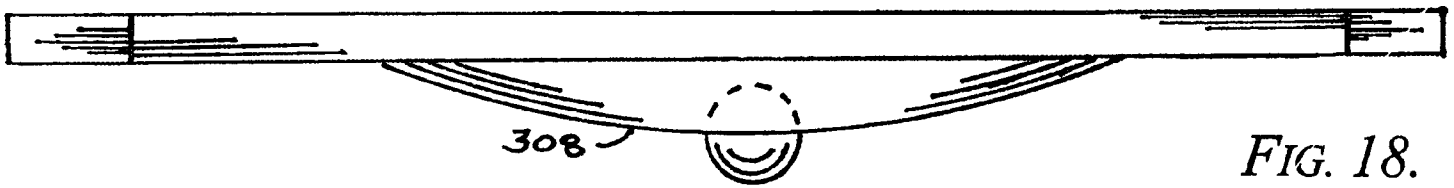
FIG. 18 is a side elevational view of FIG. 19.
Figure 19:
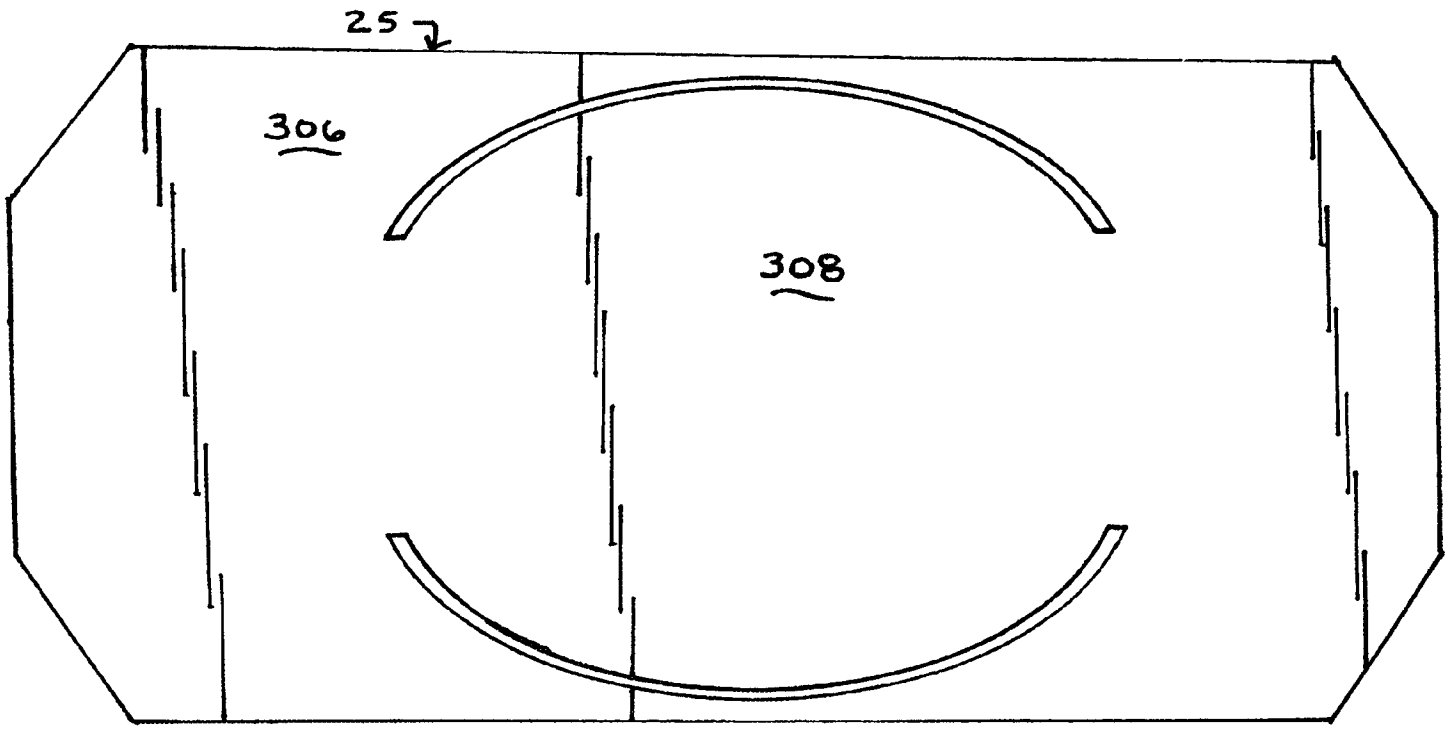
FIG. 19 is a bottom plan view comparable to FIGS. 4, 15, 16 and 17 except showing a further arrangement of the sub-frame; and, FIG. 20 is a side elevational view of an additional embodiment of a balance training apparatus in accordance with the invention.

FIGS. 18 and 19 shows the platform 25 provided with a further arrangement of a sub-frame, indicated here by reference numeral 306. FIGS. 18 and 19 show the sub-frame 306 is constructed out of two crescent shaped beams facing each other bearing surface 308.

Figure 20:
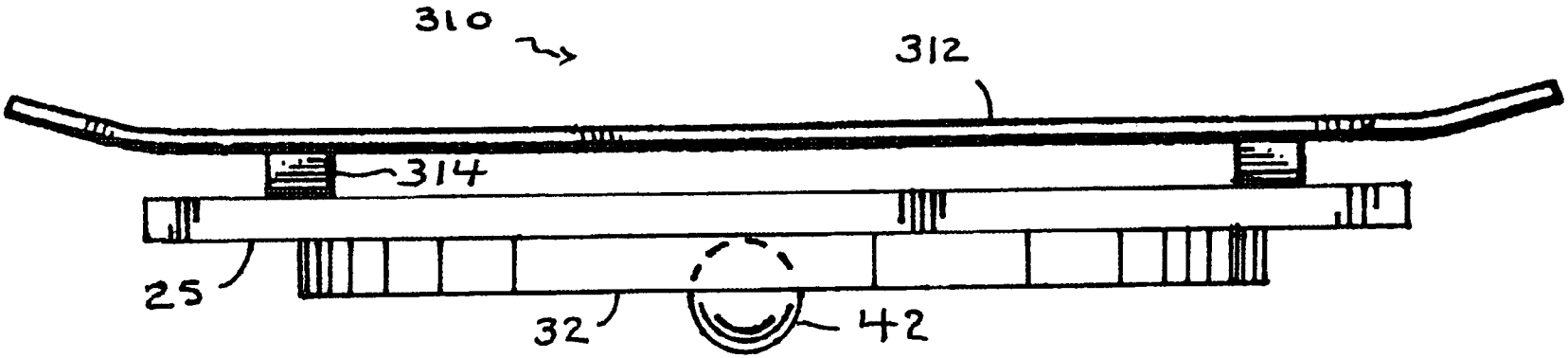

FIG. 20 shows an additional embodiment of a balance training apparatus 310 in accordance with the invention. An upper deck 312 is mounted on mounting blocks 314 mounted on platform 25, which has sub-frame 32 and rolling fulcrum 42. The upper deck 312 is shaped to simulate a skate board deck.

The upper deck provides greater toe and heel contact for the user which better simulated skateboarding. It might also create a quicker response time during the balancing activity.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. Balance training apparatus comprising:

a balance board having an upper footstep surface and lower bearing surface;

a sub-frame framing-in a generally circular framed-in area of the bearing surface;

a generally spherical rolling fulcrum for being crowned by the balance board within the sub-frame as well as for engaging a ground surface at the same time as any part of the framed-in area of the bearing surface, wherein said spherical rolling fulcrum is free to roll sandwiched between said balance board and ground surface unless stopped against any portion of the sub-frame;

wherein the generally circular framed-in area of the bearing surface is characterized by an inside diameter as the generally spherical rolling fulcrum is characterized a nominal outside diameter such that the framed-in area's inside diameter encompasses size ratios relative to the rolling fulcrum's nominal outside diameter by between about 12½ to 2½ and 6½ to 7.

2. The balance training apparatus of claim 1 wherein:

wherein the rolling fulcrum comprises an inflatable ball and the nominal outside diameter thereof comprises the diameter when inflated to a generally spheric shape.

3. The balance training apparatus of claim 1 wherein:

the framed-in area's inside diameter encompasses size ratios relative to the rolling fulcrum's nominal outside diameter by between about 12½ to 5 and 9½ to 7.

4. The balance training apparatus of claim 1 wherein:

the framed-in area's inside diameter encompasses size ratios relative to the rolling fulcrum's nominal outside diameter by between about 12½ to 2½ and 6½ to 5.

5. The balance training apparatus of claim 1 wherein:

the sub-frame comprises a generally cylindrical inside sidewall defining the generally circular framed-in area of the bearing surface; and the inside sidewall is characterized by a height such that the rolling fulcrum's nominal outside diameter encompasses size ratios relative to the inside sidewall's height by between about 2½ to 1¾ and 7 to 1¾.

6. The balance training apparatus of claim 1 wherein:

the framed-in area of the bearing surface is either flat or domed.

7. Balance training apparatus comprising:

a balance board having an upper footstep surface and lower bearing surface;

a sub-frame framing-in a framed-in area of the bearing surface;

a generally spherical rolling fulcrum for being crowned by the balance board within the sub-frame as well as for engaging a ground surface at the same time as any part of the framed-in area of the bearing surface, wherein said spherical rolling fulcrum is free to roll sandwiched between said balance board and ground surface unless stopped against any portion of the sub-frame;

wherein the framed-in area of the bearing surface is characterized by either maximum inside either diameter or diagonal as the generally spherical rolling fulcrum is characterized a nominal outside diameter such that the framed-in area's maximum inside either diameter or diagonal encompasses size ratios relative to the rolling fulcrum's nominal outside diameter by between about 12½ to 2½ and 6½ to 7.

8. The balance training apparatus of claim 7 wherein:

wherein the rolling fulcrum comprises an inflatable ball and the nominal outside diameter thereof comprises the diameter when inflated to a generally spheric shape.

9. The balance training apparatus of claim 7 wherein:

the framed-in area's maximum inside either diameter or diagonal encompasses size ratios relative to the rolling fulcrum's nominal outside diameter by between about 12½ to 5 and 9½ to 7.

10. The balance training apparatus of claim 7 wherein:

the framed-in area's maximum inside either diameter or diagonal encompasses size ratios relative to the rolling fulcrum's nominal outside diameter by between about 12½ to 2½ and 6½ to 5.

11. The balance training apparatus of claim 7 wherein:

the sub-frame comprises a generally tubular inside sidewall defining the framed-in area of the bearing surface; and the inside sidewall is characterized by a height such that the rolling fulcrum's nominal outside diameter encompasses size ratios relative to the inside sidewall's height by between about 2½ to 1¾ and 7 to 1¾.

12. The balance training apparatus of claim 7 wherein:

the framed-in area of the bearing surface is either flat or domed.

* * * * *